US011085244B2

(12) United States Patent
Li et al.

(10) Patent No.: US 11,085,244 B2
(45) Date of Patent: Aug. 10, 2021

(54) ANTI-COLLAPSE JET GROUTING DRILL BIT WITH BI-DIRECTIONAL RIB WINGS, GROUTING CONSOLIDATION SYSTEM AND METHOD

(71) Applicant: SHANDONG UNIVERSITY, Shandong (CN)

(72) Inventors: Shucai Li, Jinan (CN); Qingsong Zhang, Jinan (CN); Guangming Pan, Jinan (CN); Rentai Liu, Jinan (CN); Xiao Zhang, Jinan (CN); Lei Yang, Jinan (CN); Kai Wang, Jinan (CN); Zhaofeng Li, Jinan (CN); Haitong Sui, Jinan (CN); Teng Yang, Jinan (CN); Chunguo Liu, Jinan (CN)

(73) Assignee: SHANDONG UNIVERSITY, Shandong (CN)

( * ) Notice: Subject to any disclaimer, the term of this patent is extended or adjusted under 35 U.S.C. 154(b) by 632 days.

(21) Appl. No.: 15/757,681

(22) PCT Filed: Jul. 11, 2016

(86) PCT No.: PCT/CN2016/089686
§ 371 (c)(1),
(2) Date: May 10, 2018

(87) PCT Pub. No.: WO2017/028645
PCT Pub. Date: Feb. 23, 2017

(65) Prior Publication Data

US 2019/0024460 A1 Jan. 24, 2019

(30) Foreign Application Priority Data

Aug. 18, 2015 (CN) ..... 201510509181.5
Aug. 18, 2015 (CN) ..... 201510509238.1

(51) Int. Cl.
*E21B 10/60* (2006.01)
*E21B 33/13* (2006.01)
(Continued)

(52) U.S. Cl.
CPC ..... *E21B 10/60* (2013.01); *E02D 3/12* (2013.01); *E21B 10/003* (2013.01); *E21B 10/42* (2013.01); *E21B 33/13* (2013.01)

(58) Field of Classification Search
CPC . E21B 33/13; E21B 10/60; E21B 7/18; E02D 3/12
See application file for complete search history.

(56) References Cited

U.S. PATENT DOCUMENTS 6,820,696 B2 * 11/2004 Bergman ..... B65G 5/00 166/369
2011/0011646 A1 * 1/2011 Giroux ..... E21B 17/14 175/61

FOREIGN PATENT DOCUMENTS

CN 101634218 A 1/2010
CN 102561950 A 7/2012
(Continued)

OTHER PUBLICATIONS

Oct. 19, 2016 International Search Report issued in International Patent Application No. PCT/CN2016/089686.
(Continued)

*Primary Examiner* — Sean D Andrish
(74) *Attorney, Agent, or Firm* — Oliff PLC

(57) ABSTRACT

An anti-collapse grouting consolidation system including: a grouting pump; an outer flat drill rod; a drill rig that clamps the outer flat drill rod; a sealing device, sheathed on the outer flat drill rod at the orifice of a drill hole, ensuring the outer flat drill rod is sealed with the orifice of the drill hole; and a jet grouting drill bit with bi-directional rib wings. The
(Continued)

grouting pump jets slurry into the drill hole in a static osmotic manner through the jet grouting drill bit. A method of using an anti-collapse grouting consolidation system includes, among other things, injecting quick-setting slurry; sealing an orifice hole of the drill hole by an orifice sealing device; and keeping an anti-collapse jet grouting drill bit with bi-directional rib wings repeatedly moving up and down and rotating at a repair segment to repair the repair segment.

15 Claims, 9 Drawing Sheets

(51) Int. Cl.

| | |
|---|---|
| ***E02D 3/12*** | (2006.01) |
| ***E21B 10/00*** | (2006.01) |
| ***E21B 10/42*** | (2006.01) |

(56) References Cited

FOREIGN PATENT DOCUMENTS

| | | | |
|---|---|---|---|
| CN | 203978378 | U | 12/2014 |
| CN | 105041218 | A | 11/2015 |
| CN | 105134127 | A | 12/2015 |
| CN | 105201447 | A | 12/2015 |
| EP | 0293584 | A1 | 12/1988 |
| SE | 427487 | B | 4/1983 |

OTHER PUBLICATIONS

Feb. 20, 2018 International Preliminary Report on Patentability issued in International Patent Application No. PCT/CN2016/089686.

* cited by examiner

ANTI-COLLAPSE JET GROUTING DRILL BIT WITH BI-DIRECTIONAL RIB WINGS, GROUTING CONSOLIDATION SYSTEM AND METHOD

FIELD OF THE INVENTION

The present invention relates to a non-lift anti-collapse jet grouting drill bit with bi-directional rib wings for a weak, broken stratum drill hole, a grouting consolidation system and method, all of which belongs to the field of drilling and surrounding rock grouting reinforcement of mines, traffic, tunnels of water conservancy and hydropower, as well as underground engineering.

BACKGROUND OF THE INVENTION

Nowadays, in the construction of mines, tunnels and underground engineering, unfavorable geological environments, such as weak, broken and even water-rich cases are often encountered. Also, it is common to see surrounding rock deformation, collapse and even water and/or mud outburst on the mentioned actual conditions. Indeed, during the control of geological disasters, more attention should be paid on unfavorable geological bodies by grouting reinforcement. However, in the operation of drilling grouting holes, the instability phenomena on the hole wall, e.g. shrinkage, collapse, and chipping, is also widely reported. Thus, it is bound to cause drilling tools buried and clamped. In order to prevent drilling accidents due to instability, grouting reinforcement needs to be specifically carried out on the drilling walls, in addition to the precaution. In the process of drilling, a ribbed drill bit is used in soft rock and easy-to-shrink strata in order to both increase the diameter of the drilling hole and adjust the performance of flushing fluid (grouting reinforcement). Once drilling accidents occur due to hole wall shrinkage, collapse, and chipping, a handling measure is adopted to detach the drill rod above the buried or clamped part, and then lift it out from the drill hole. While extracting the buried or clamped part, the grouting on drilling hole is operated. After grouting, the drilling tool is laid down for drilling again, and so forth. The measure has the disadvantages that drilling and grouting are discontinuous, with process steps not connected very well, resulting in a low efficiency; as slurry is pressed into a full length of hole via an orifice pipe, the weak, broken deep part of the drill hole is not grouted in a highly targeted manner, so that the grouting reinforcement effect is poor. Because of the above characteristics of the traditional drilling machines, the setting waiting time of the cement slurry used is very long, generally 72 hours. In the same weak broken hole segment, accidents of hole wall collapse while the slurry is not solidified often occur, causing repeated grouting and repeated drilling to waste a lot of time and cost. This is extremely unfavorable to the emergency work of controlling water and/or mud outburst. When the above problems occur in key drilling and results in failure of the key hole, irreparable loss will be caused for the entire disaster control work.

The conventional grouting drill or reinforcing structure device has the following disadvantages:

1. The anti-collapse drill bits for drilling weak, broken strata are generally three-wing coreless drill bits or PDC coreless ones. During drilling, the drill bit can only advance and rotate in the collapsing and chipping hole, while cannot be pulled back. Once hole wall shrinkage or chipping occurs between the drill rod above the drill bit and the hole wall, the drilling tool is bound to be clamped. Due to the absence of upward and lateral cutting edges, it is hard to eliminate hole wall shrinkage o/collapsing and chipping above the drill, and thus difficult to lift the drilling tool out.

2. The water port of the conventional drill bit is designed at the bottom part, so it is difficult to consolidate the hole wall by jetting the slurry. Even though the slurry is jetted through the water port on the drill bit body, the slurry can only be jetted towards the bottom of the drill bit, but can hardly be jetted to the side and the upper part. So, the slurry is not jetted uniformly in a targeted manner, and the reinforcement effect on the weak, broken surrounding rock is poor.

3. Due to short setting time, complicated operation process and high safety risk of quick-setting slurry, when the conventional drilling tool is clamped or falling down, the drill bit cannot be pulled back. Therefore, the accident cannot be properly managed within the initial setting time of the slurry, which causes setting of the quick-setting slurry and consolidation of the drill bit and the hole wall, resulting in an more complex engineering accident. Based on the mentioned above, it is not feasible to choose quick-setting slurry, the slurry having the setting waiting time of 72 hours is used, during grouting, thus greatly delaying the construction progress.

In order to overcome the above disadvantages in the prior art, the present invention provides an anti-collapse jet grouting drill bit with bi-directional rib wings, a non-lift anti-collapse grouting consolidation system, and a using method thereof. The anti-collapse jet grouting drill bit with bi-directional rib wings is directly used for drilling in an unfavorable stratum, and when in-hole accidents such as hole wall shrinkage, collapse and chipping happen, the drilling tool does not need to be lifted out; instead, through rotation and up-down movement of the anti-collapse jet grouting drill bit with bi-directional rib wings, continuous operations of cutting, squeezing, and jet grouting are carried out to achieve non-lift one-time grouting consolidation on the instable hole wall surrounding rock and repair the drill hole at the same time, meanwhile, drilling and grouting are synchronized in this way.

SUMMARY OF THE INVENTION

In order to fulfill the above object, the present invention adopts the following technical solutions:

An anti-collapse jet grouting drill bit with bi-directional rib wings, including a drill bit body connected with an outer flat drill rod, wherein the rib wings, are arranged laterally of the drill bit body along the longitudinal direction of the drill bit; the rib wings include a forward wing arranged at the front end of the drill bit, a reverse wing arranged at the rear end of the drill bit, and a side wing connecting the forward wing and the reverse wing; the included angle between the forward wing and the side wing and the included angle between the reverse wing and the side wing are obtuse angles; hard alloy fragments are arranged on the rib wings; an inner through bore communicated with a through hole of the outer flat drill rod is formed in the drill bit body, and jet holes communicated with the inner through bore are formed in the surface of the drill bit body; during rotation, the drill bit moves up and down by virtue of revolution of the forward wing and the reverse wing, and the rib wings of the drill bit cut chippings from a hole wall or squeeze the chippings back into the hole wall to realize grouting reinforcement and repair of the hole wall.

The rib-shaped rib wings are arranged on the surface of the drill bit body. And during rotation, the drill bit can drive the rib wings to rotate so as to cut the chippings or squeeze the chippings back into the hole wall, which aims to repair the hole wall. By the way, the hard alloy fragments arranged on the rib wings, have the function to cut or squeeze edges into the wall of the hole, and destroy the chippings by squeezing and shearing.

The special shape of the drill bit body, and the arrangement of the forward, the reverse and the side wings, realize the function of pulling the drill bit body back to cut the chippings, and solve the technical problem that a general drill bit can only advance and rotate but cannot be pulled back. So that, once drilling accidents occur due to hole wall shrinkage, collapse, chipping and the like above the drill bit body, the drill rod above the buried or clamped part in a drill hole has to be detached and lifted out of the drill hole and then the drill bit is salvaged separately.

The rear end of the jet grouting drill bit with bi-directional rib wings is connected with the outer flat drill rod through a one-way valve; and both the buckle type of an inner buckle screw eye at the rear end of the jet grouting drill bit with bi-directional rib wings and the buckle type of the one-way valve are same as the buckle type of the outer flat drill rod.

The one-way valve can ensure the single flow direction of slurry, and thus prevent the non-solidified slurry in the drill hole from flowing back into the drill rod. The buckle type of both the inner buckle screw eye and the one-way valve are the same as the type of the outer flat drill rod, which is conducive to smooth connection of the components.

The mentioned jet holes are distributed at the front end, the side surface and the rear end of the drill bit body.

As the jet holes are formed at the front end, the side surface and the rear end of the drill bit body, the technical problem that the conventional drill bit can only jet slurry towards the bottom of the drill bit is solved. In this case, the slurry can be jetted to the side and the upper part uniformly in a more targeted manner, thus, the jet reinforcement effect on the weak, broken surrounding rock is bound to be greatly improved. Moreover, this drill bit can also be used to cooperate with the reverse/the side wing, and this is more favorable for the full repair and segmentation for drill hole collapse parts.

The three mentioned rib wings are uniformly distributed at an angle of 120° on the cross section of the drill bit body; the included angle between the forward wing and the side wing, in the same way the included angle between the reverse wing and the side wing are 135°, separately; the rib wings have a thickness of 20 mm, and a side height is determined by the difference between a drill hole diameter and the diameter of the drill bit body.

The three mentioned rib wings have upper and lower ends in the shape of triangular pyramids and are uniformly arranged at an angle of 120° on the cross section of the drill bit body, which conforms to the principle of mechanics, and can better implement the rotary cutting to eliminate the chippings or squeeze the chippings back into the hole wall.

A plurality of hard alloy fragments are arranged on the rib wings; and the distance between the side edge of each rib wing and the axis of the drill bit body is equal.

With the characteristic of high hardness, the hard alloy fragments arranged on the rib wings can further achieve the effects of squeeze-crushing and shear destroying on the chippings so as to repair the hole wall.

An anti-collapse grouting consolidation system includes:

A grouting pump;

A high-pressure pipeline, connected with the grouting pump;

An outer flat drill rod, connected with the high-pressure pipeline;

An underground drill rig, wherein the outer flat drill rod penetrates through an inner through bore of a chuck of the underground drill rig, and the chuck of the underground drill rig clamps the outer flat drill rod;

An orifice sealing device, sheathed on the outer flat drill rod at the orifice of a drill hole to ensure that the outer flat drill rod is sealed with the orifice of the drill hole;

A jet grouting drill bit with bi-directional rib wings, connected with a one-way valve which is connected with the outer flat drill rod;

wherein the grouting pump jets quick-setting slurry into the drill hole through a high-pressure hose, the outer flat drill rod and the jet rib wing drill bit successively to realize static osmotic jet grouting, and the underground drill rig drives, through the outer flat drill rod, the jet rib wing drill bit to rotate, and cuts chippings or squeezes the chippings back into the hole wall through rotation of the jet slurry and the rib wings so as to repair the hole wall.

The anti-collapse grouting consolidation system can function to prevent drill locking in the construction process, and can effectively control the operation time for the drill rig to repair the hole wall, so the quick-setting slurry can be jetted to the drill hole, in this situation, the construction time and cost is greatly saved and reduced.

An orifice sealing device for static osmotic jet grouting for a drill hole includes:

A pipe protection flange, connected with an orifice pipe;

An inner bushing arranged in the orifice pipe and an inner bushing bottom holder, wherein an inner bushing flange is arranged at the upper port of the inner bushing, the lower end of the inner bushing is connected with the inner bushing bottom holder, and the inner bushing bottom holder is disc-shaped and is provided in the center with a circular hole through which the outer flat drill rod passes;

A water seal, disposed in the inner bushing, and used for sealing the clearance between the outer flat drill rod and the inner bushing, wherein a water inlet pipe and a high-pressure valve connected with the water inlet pipe are arranged on the water seal; And after water injection, a gland flange used for limiting expansion of the water weal, wherein the sealing and its degree of the orifice sealing device is controlled by adjusting the quantity of water injected into the water seal, in order to adapt to corresponding situations for different sealing requirements of the drill hole.

The orifice sealing device is provided with the orifice pipe, which can effectively seal the orifice of the drill hole to ensure the sealing effect of the orifice sealing device. The orifice sealing device is convenient to detach to meet the requirement during cleaning of the drill hole.

The sealing and its degree of the orifice sealing device can be controlled by adjusting the water injection quantity of the water seal to adapt to corresponding situations for different sealing requirements of the drill hole: when clear water is not injected into the water seal, a clearance can be reserved at the orifice to adapt to flexible rotation and movement of the drill rod & the drill bit, in order to ensure that cement slurry or clear water flows out of the clearance. As to another function, it is easy to observe whether the drill hole is full of slurry; moreover, after clear water is injected into the water seal, the effect of sealing the orifice can be achieved, so that the slurry can reach certain pressure.

The ingenious design of the inner bushing, the inner bushing bottom holder and the inner bushing flange, can not only solve the problem of placement of the water seal, but achieve a further sealing effect.

The gland flange is designed to fix the water seal that expands after water injection. Meanwhile, the expansion direction of the water seal can also be controlled, so that the water seal can only expand towards the direction of the drill rod.

The pipe protection flange is in screwed connection with the orifice pipe.

The inner bushing bottom holder, the inner bushing and the inner bushing flange are welded into a whole.

As the inner bushing bottom holder, the inner bushing and the inner bushing flange are welded into a whole, the integrity is good, installation and operation are convenient, and the sealing effect is good.

A second sealing gasket is arranged between the pipe protection flange and the inner bushing flange. And a first sealing gasket is arranged between the inner bushing flange and the gland flange; and the mentioned pipe protection flange, the inner bushing flange and the gland flange are connected by fastening bolts.

The sealing gaskets are arranged among the flanges to ensure the tightness of the sealing device, and thus prevent the slurry from overflowing.

The diameter of the circular hole of the inner bushing bottom holder is 4-6 mm greater than that of the outer flat drill rod; while, the inner diameter of the inner bushing flange is the same as that of the inner bushing; and the outer diameter of the inner bushing flange is greater than that of the orifice pipe and same as that of the pipe protection flange.

The diameter of the circular hole of the flange gland is 4-6 mm greater than that of the outer flat drill rod, while, the inner diameter of the inner bushing flange is the same as that of the inner bushing, and the outer diameter of the inner bushing flange is greater than that of the orifice pipe; the water seal is made of an elastic material with a ring shape, the outer diameter of the water seal is the same as the inner bushing, and the inner diameter of the ring is the same as the circular hole of the inner bushing bottom holder. This design can meet the requirement of slurry overflow when the drill hole is flushed. During high-pressure grouting, the effect of high-pressure sealing can be achieved by the water seal, so the design is ingenious.

The water seal is made of an elastic wear-resistant material with a ring shape, the outer diameter of the ring is the same as the one of the inner bushing, and the inner diameter of the ring is the same as the one of the circular hole of the inner bushing bottom holder.

As the water seal is made of the elastic wear-resistant material, when clear water is not injected, the requirement of reserving a clearance at the orifice can be satisfied; after injected, the elastic material expands to achieve a sealing effect.

The water inlet valve at the water seal is a high-pressure valve and has the same diameter as the water inlet, and also, a water pipe having the same diameter is connected outside the high-pressure valve.

The high-pressure valve arranged at the water seal can meet the requirement for the water injection pressure and ensure the tightness of the orifice sealing device.

Alternatively, the orifice sealing device provided by the present invention is composed of drag sleeves, fastening bolts, cotton packing threads and press members: the drag sleeves are connected with the orifice pipe by screw threads; afterwards, the outer flat drill rod passes through the drag sleeves; the cotton packing threads are filled into the drag sleeves; and the press members are installed. The pressing members are connected with the drag sleeves together by the fastening bolts, the fastening bolts are screwed, the cotton packing threads are pressed by the press members, and the cotton packing threads expand to close the clearance with the outer flat drill rod.

An installation method of the anti-collapse grouting consolidation system includes the following steps:

Step 1: connecting a jet rib wing drill bit, a one-way valve and an outer flat drill rod successively from the bottom to the top;

Step 2: installing a sealing device, sheathing the mentioned sealing device outside the outer flat drill rod, and fixing the sealing device at the orifice of a drill hole;

Step 3: after crossing a chuck of an underground drill rig for the outer flat drill rod, connecting it with a high-pressure pipeline and a grouting pump successively.

In step 2, the installed sealing device includes: to put the inner bushing bottom holder, the inner bushing and the inner bushing flange into an orifice pipe connected with a pipe protection flange; to put the water seal into the inner bushing, to connect the gland flange with the inner bushing flange and the pipe protection flange via fastening holes. It is worth mentioning that, a sealing gasket should be placed between the flanges, and the water inlet of the water seal also should be connected with a high-pressure valve.

A using method of the anti-collapse grouting consolidation system includes the following steps:

Step 1: feeding a jet grouting drill bit with bi-directional rib wings connected with an outer flat drill rod into a certain depth, sheathing a sealing device outside the outer flat drill rod, fixing the sealing device at the orifice of the drill hole, and connecting the outer flat drill rod to a high-pressure pipeline and a grouting pump successively after the outer flat drill rod passes through a chuck of an underground drill rig;

Step 2: injecting thin cement slurry into the drill hole to flush the drill hole; when the drill hole is full of the thin cement slurry, starting the drill rig so that the jet grouting drill bit with bi-directional rib wings rotates, afterward, changing to inject quick-setting slurry, until it overflows between the orifice sealing device and the drill rod;

Step 3: sealing the orifice of the drill hole by the orifice sealing device, then conveying the rotating drill bit to a repair segment by the outer flat drill rod, stopping injecting the quick-setting slurry when the grouting pressure reaches a set value, and continuing keeping the anti-collapse jet grouting drill bit with bi-directional rib wings repeatedly moving up and down and rotating at the repair segment to repair the repair segment, until the repair process meets the set requirement;

Step 4: when the repair reaches a setting time, pulling out the outer flat drill rod from the drill hole so that the jet grouting drill bit with bi-directional rib wings leaves the hole segment that needs grouting reinforcement and drilling repair, and releasing the seal of the sealing device at the orifice; injecting clear water into the drill hole until the clear water overflows between the orifice sealing device and the outer flat drill rod, stopping the drill rig after the drill bit rotates freely in the drill hole, and detaching the outer flat drill rod at the orifice; and Step 5: detaching the orifice sealing device, reconnecting the outer flat drill rod, pumping clear water into the drill hole via the grouting pump, starting the drill rig to rotate slowly and pulling up the outer flat drill rod after the clear water returns from the orifice, so that the rib wing at the upper end of the jet grouting drill bit with bi-directional rib wings cuts towards the external direction of the drill hole to clear away the solidified quick-setting slurry in the drill hole, and detaching the outer flat drill rod piece by piece, until the jet grouting drill bit with bi-directional rib wings is lifted out of the drill hole, thus ending the operation steps.

The sealing device is closed after the quick-setting slurry overflows the clearance between the orifice sealing device and the drill rod, thus ensuring that all the thin cement slurry in the drill hole is discharged out of the drill hole, and the whole drill hole is then full of the quick-setting slurry; and static pressure grouting is continued to ensure the effect of grouting on the full length of the drill hole.

Slurry injection is continued to reach set grouting pressure after the sealing device is closed in step 3, thus forming static pressure in the drill hole. Rotary jet is performed on the hole wall under the static pressure, on the one hand, osmotic grouting on the hole wall is achieved, which is conductive to restore the stability thereof; and on the other hand, the drill bit rotates for stirring relatively smoothly, thus powerfully ensuring the repair effect on the hole wall. After the repair process is completed and the seal is released, the hole is opened rather than closed. At that time, clear water is injected via the grouting pump. The clear water can be ejected from the jet holes to clean the grouting pipeline, the outer flat drill rod, the inner bore of the drill bit and the jet holes and clean the spaces in the holes on the circumference of the drill rod above the drill bit body, thus preventing the drill bit and drill rod from being consolidated by the slurry.

In step 2, the density of the thin cement slurry is controlled at 1.2-1.4 g/cm$^3$; the pump volume of the grouting pump is not more than 100 L/min; the rotating speed of the outer flat drill rod driven by the underground drill rig is not more than 150 r/min; after the orifice sealing device is sealed with the outer flat drill rod, no leakage is required when the grouting pressure in the drill hole 1.5 MPa; the initial setting time of the quick-setting slurry is controlled at about 20-25 min; the limit value of the grouting pressure of the grouting pump is 1.5 MPa; the pump volume of injecting the quick-setting slurry should not exceed 40 L/min; and the volume of the quick-setting slurry injected into the drill hole is controlled between 1.5 and 2.0 times the internal volume of the drill hole.

The density of the thin cement slurry is controlled at this interval, on the one hand, it will not damage the hole wall by immersion, such as, clear water; and on the other hand, the gaps of the hole wall surrounding rock will not be blocked by thick slurry to affect later penetration and diffusion effects of the quick-setting slurry.

The slurry in the drill hole is boosted up to 1.5 MPa (sealed anti-leakage pressure), thus ensuring no leakage at the sealed position when the grouting pressure reaches 1.2 MPa and also achieving a certain safety margin.

The initial setting time is controlled within 20-25 min, which is a safety time from grouting to withdrawal of the drill bit from the drill hole.

The volume of the quick-setting slurry injected into the drill hole is controlled between 1.5-2.0 times the internal volumes of the drill hole. The volume is controlled in this range, so that on the one hand, the hole wall can be consolidated and stable, and the consolidated drill hole does not collapse or chip; and on the other hand, if the injection volume is greater than the diffusion volume, the pressure in the hole increases rapidly and exceeds the maximum sealing pressure of the sealing device, causing leakage and unfavorable for rotary jet grouting consolidation safety and effect.

In step 3, the grouting pressure is designed at 1.0-1.2 MPa. The rotating speed of the outer flat drill rod driven by the underground drill rig is not more than 150 r/min, and the up-down moving speed of the outer flat drill rod is not more than 10 m/min.

The grouting pressure of the grouting pump is controlled at 1.0-1.2 MPa, which not only can meet the permeation of the injected slurry in the gaps of the hole-wall weak, broken surrounding rock, but also prevents the stability of the weak, broken surrounding rock from being destroyed due to the higher grouting pressure than the ultimate strength of the weak, broken surrounding rock.

In step 4, the specified repair setting time is 3 minutes before the quick-setting slurry's one; the pump volume of injecting the clear water is not less than 100 L/min; and when the clear water flows out from the orifice and the drill bit rotates freely in the drill hole, the drill rig stops rotating.

The hole wall is repaired continuously before initial setting of the quick-setting slurry, thus ensuring sufficient time to repair the hole wall.

The present invention has the following beneficial effects:

When the jet rib wing drill bit encounters hole wall shrinkage, collapse chipping (hereinafter referred to as instable hole wall) in the drill hole, the chippings can be cut or squeezed back into the hole wall by virtue of revolution of the rib wings of the jet grouting drill bit with bi-directional rib wings. And the instable hole wall is repaired via rotation of the rib wings to achieve a normal cylindrical drill hole state. The bidirectional anti-collapse jet rib wing drill bit repeatedly moves and rotates on the instable hole wall segment to repair the hole wall, till the hole wall is repaired.

The bidirectional anti-collapse jet rib wing drill bit continuously rotates while moving up and down in the drill hole. Through continuous rotation and movement, the rib wings of the bidirectional anti-collapse jet rib wing drill bit cut and stir the chippings or collapsed matters in the drill hole, the injected quick-setting slurry is mixed together with the chippings or collapsed matters to form a material similar to plain concrete, and the material is squeezed into the drill hole wall surrounding rock via rotation of the rib wings of the drill bit; the grouting pressure of the grouting pump is controlled at 0.5-1.2 MPa during jet grouting, so that the quick-setting slurry can effectively permeate the weak, broken drill hole wall surrounding rock by means of the grouting pressure provided by the grouting pump, and the solidified slurry functions to reinforce the weak, broken surrounding rock.

The volume of the injected quick-setting slurry is calculated based on the internal volume of the drill hole. Generally, the volume of the injected slurry is controlled at 1.5-2.0 times the internal volume of the drill hole, and the weak and broken degree of the hole wall surrounding rock is also taken into account to ensure the grouting effect.

When the quick rising pressure of the grouting pump is observed, the slurry is filled to saturation, and then, grouting is stopped. In the following, clear water is injected into the high-pressure pipeline and the outer flat drill rod via the grouting pump to flush the inner bore of the pipeline, thus preventing the injected slurry from blocking the inner bores of the high-pressure pipeline and the outer flat drill rod.

During the whole process, rotating or moving of the outer flat drill rod, the one-way valve, and the bidirectional anti-collapse jet rib wing drill bit is forbidden, before the injected slurry is solidified in the drill hole surrounding rock. The above mentioned devices continuously rotate and move in order to prevent the injected slurry from forming a consolidated body within the moving range of the bidirectional anti-collapse jet rib wing drill bit, the outer flat drill rod and the one-way valve to be consolidated in the drill hole, and to ensure that the bidirectional anti-collapse jet rib wing drill bit has a certain movable space in the drill hole and certain annular gaps are formed between the consolidated body of the injected slurry remaining in the drill hole and the outer flat drill rod and the one-way valve.

The underground drill rig is started after the clear water flows out of the orifice, and the chuck of the underground drill rig drives the outer flat drill rod to rotate and transmits the rotating torque to the bidirectional anti-collapse jet rib wing drill bit. Meanwhile, the chuck of the underground drill rig can provide outward tension for the outer flat drill rod. After the tension is transmitted to the bidirectional anti-collapse jet rib wing drill bit, it is used as pressure for the ribs at the upper end of the drill bit to cut the consolidated body of the injected slurry remaining in the drill hole, in which the principle is equivalent to a reverse re-drilling process. This continues until the consolidated body of the injected slurry remaining in the drill hole is removed, and the bidirectional anti-collapse jet rib wing drill bit is lifted out of the drill hole.

In the present invention, the anti-collapse grouting consolidation system can be directly used for drilling in an unfavorable stratum. When in-hole accidents such as hole wall shrinkage, collapsing and chipping are encountered, the drilling tool does not need to be lifted out; instead directly through rotation and up-down movement of the anti-collapse jet grouting drill bit with bi-directional rib wings, continuous operations of cutting, squeezing, jet grouting and the like are carried out to achieve non-lift one-time grouting reinforcement on the instable hole wall surrounding rock and repair the drill hole at the same time, and drilling and grouting are synchronized in this way. The quick-setting slurry substitutes for cement slurry, thus greatly shortening the setting waiting time after grouting; and the cutting expansion function of the reverse wings at the upper end of the drill bit can be utilized after grouting, the drilling tool can be lifted out of the drill hole safely and successfully via rotation and tension, and the upper drill hole can be repaired.

Reference signs: 1 A-type orifice sealing device, 2 A-type orifice pipe, 3 drill hole, 4 outer flat drill rod, 5 one-way valve, 6 jet grouting drill bit with bi-directional rib wings, 7 hole wall, 8 rock wall, 9 fastening bolt, 10 drag sleeve, 11 cotton packing thread, 12 press member, 13 inner thread screw eye, 14 rib wing, 15 drill body, 16 inner through bore, 17 jet hole, 18 hole wall shrinkage-collapse chipping, 19 forward wing, 20 reverse wing, 21 lateral rib, 22 underground drill rig, 23 high-pressure pipeline, 24 grouting pump, 25 chuck, 26 quick-setting slurry flow direction, 27 up-down direction, 28 rightward rotation, and 29 surrounding rock;

31 B-type orifice sealing device, 32 B-type orifice pipe, 34 water bag, 38 first sealing gasket, 39 gland flange, 40 second sealing gasket, 41 inner bushing flange, 42 inner bushing, 43 inner bushing bottom holder, 44 water seal, 45 fastening bolt, 46 high-pressure valve, 47 pipe protection flange.

DETAILED DESCRIPTION OF THE EMBODIMENTS

The present invention will be further illustrated via the following specific embodiments. It should be noted that the following description is merely for the purpose of illustrating the invention, but not for limiting the invention.

Embodiment 1

A coal mine in Heze, Shandong Province is very complicated in hydro-geological condition. Concentrated and disperse burst water appears at the roof of a main return raising airway of the mine. The water burst area is large, the total amount of burst water is about 25 $m^3/h$. The burst water comes from fine sandstone (M5), and the normal water pressure of the water-bearing layer of the harnessed region is 3.5 MPa. When the M5 is grouted to plug the drill hole during construction, the shallow surrounding rock 29 is weak and broken, and the wall of the drill hole collapses seriously, so that drilling accidents happen frequently; the conventional method of grouting the whole hole for reinforcement via an orifice pipe is hardly effective; cement slurry is grouted, and the setting time of the cement slurry is 72 hours according to the design, so the setting waiting time is long, and the phenomena of collapse and chipping still occur sometimes during re-drilling in the drill hole after grouting reinforcement. The project progress is seriously affected. Later, an anti-collapse grouting consolidation device was researched and applied to achieve success of a one-time grouting consolidation. The accident rate and the closure time are greatly reduced, and the effect is significant.

Figure 6:
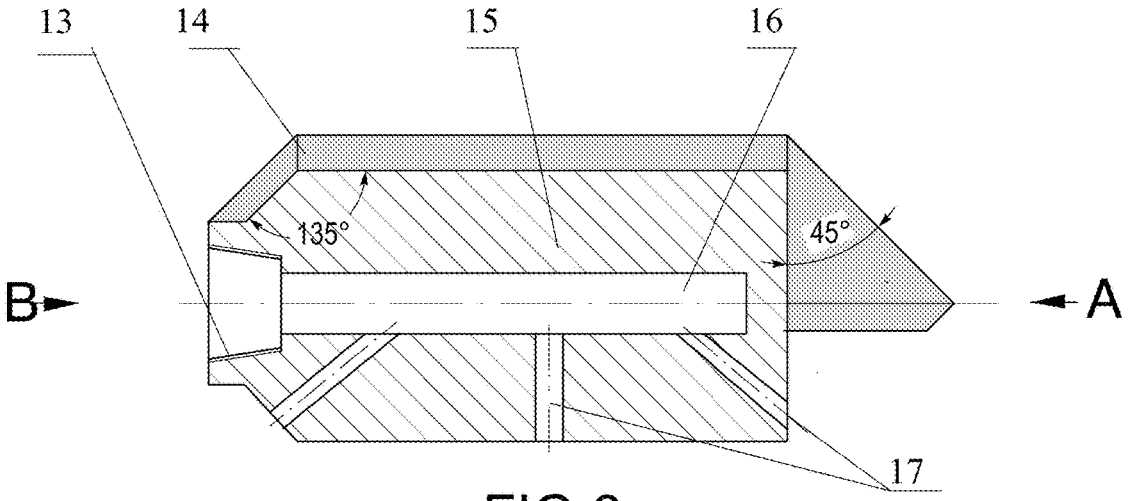
FIG. 6 is a structure diagram of an A-type jet grouting drill bit with bi-directional rib wings.
Figure 7:
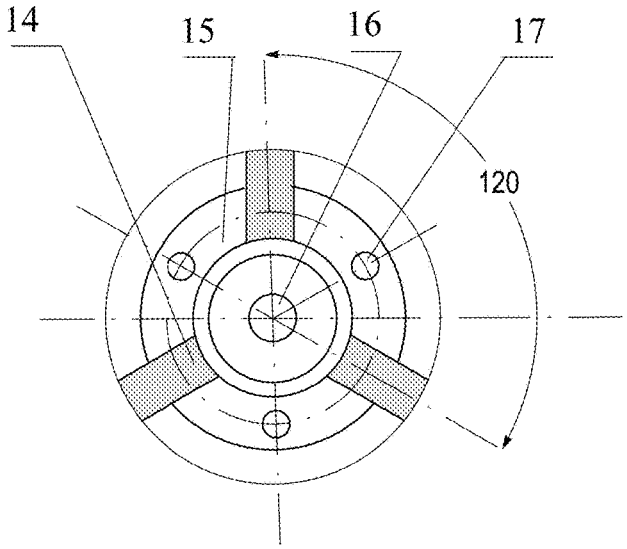
FIG. 7 is a B-directional view of the A-type jet grouting drill bit with bi-directional rib wings.
Figure 8:
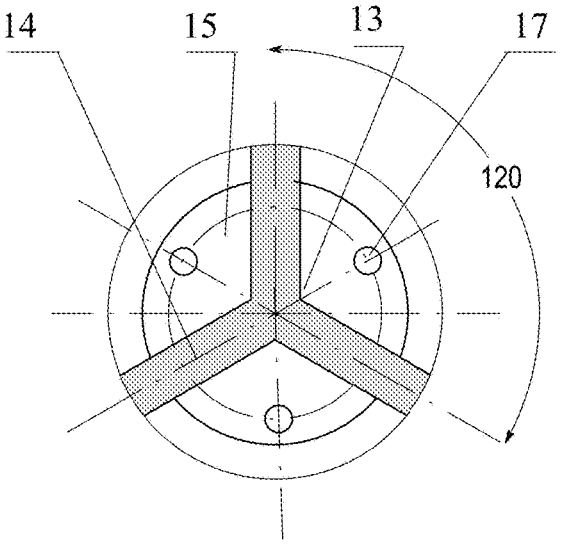
FIG. 8 is an A-directional view of the A-type jet grouting drill bit with bi-directional rib wings.

The jet grouting drill bit 6 with bi-directional rib wings shown in FIG. 6 is mainly composed of an inner thread screw eye 13 matched and connected with a one-way valve 5, rib wings 14, a drill bit body 15, an inner through bore 16, jet holes 17 and the like. FIG. 7 and FIG. 8 show the projections of the two ends of the jet grouting drill bit 6 with bi-directional rib wings.

Figure 10:
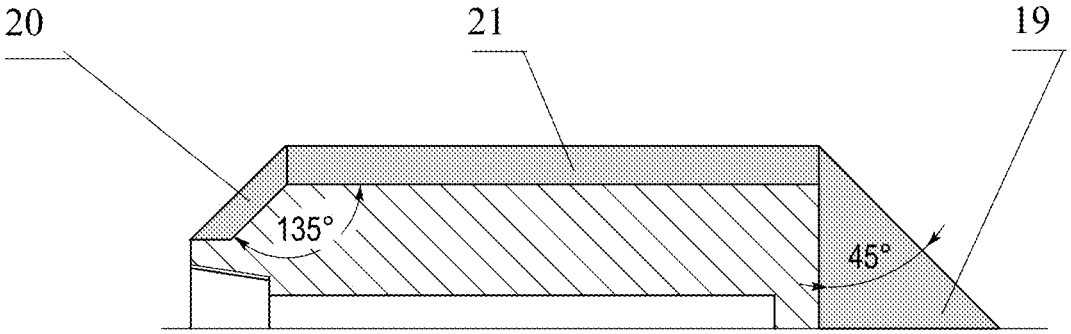
FIG. 10 is a structure diagram of a rib wing.

As shown in FIG. 10, the rib wing is arranged laterally of the drill bit body along the longitudinal direction of the drill bit. And the rib wings include a forward wing 19 arranged at the front end of the drill bit, a reverse wing 20 arranged at the rear end of the drill bit, and a side wing 21 connecting the forward wing 19 and the reverse wing 20. The included angle between the forward wing 19 and the side wing 21, as well as the included angle between the reverse wing 20 and the side wing 21 are obtuse angles.

The rib wings are connected with the drill bit body fixedly or movably. The conventional connection forms fall into the protection scope of the present invention.

Figure 1:
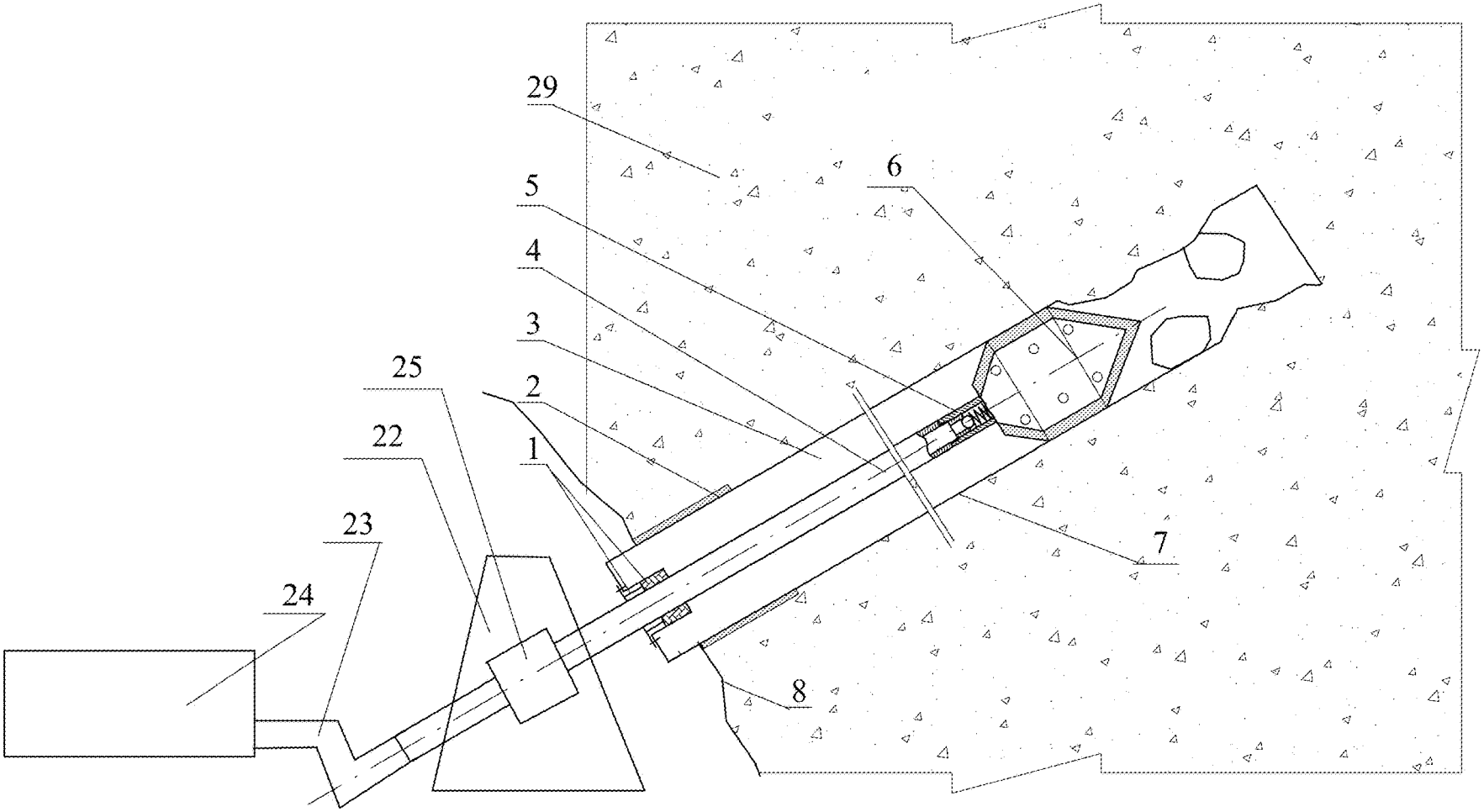
FIG. 1 is a schematic diagram of an installation structure of an A-type anti-collapse grouting consolidation system.
Figure 11:
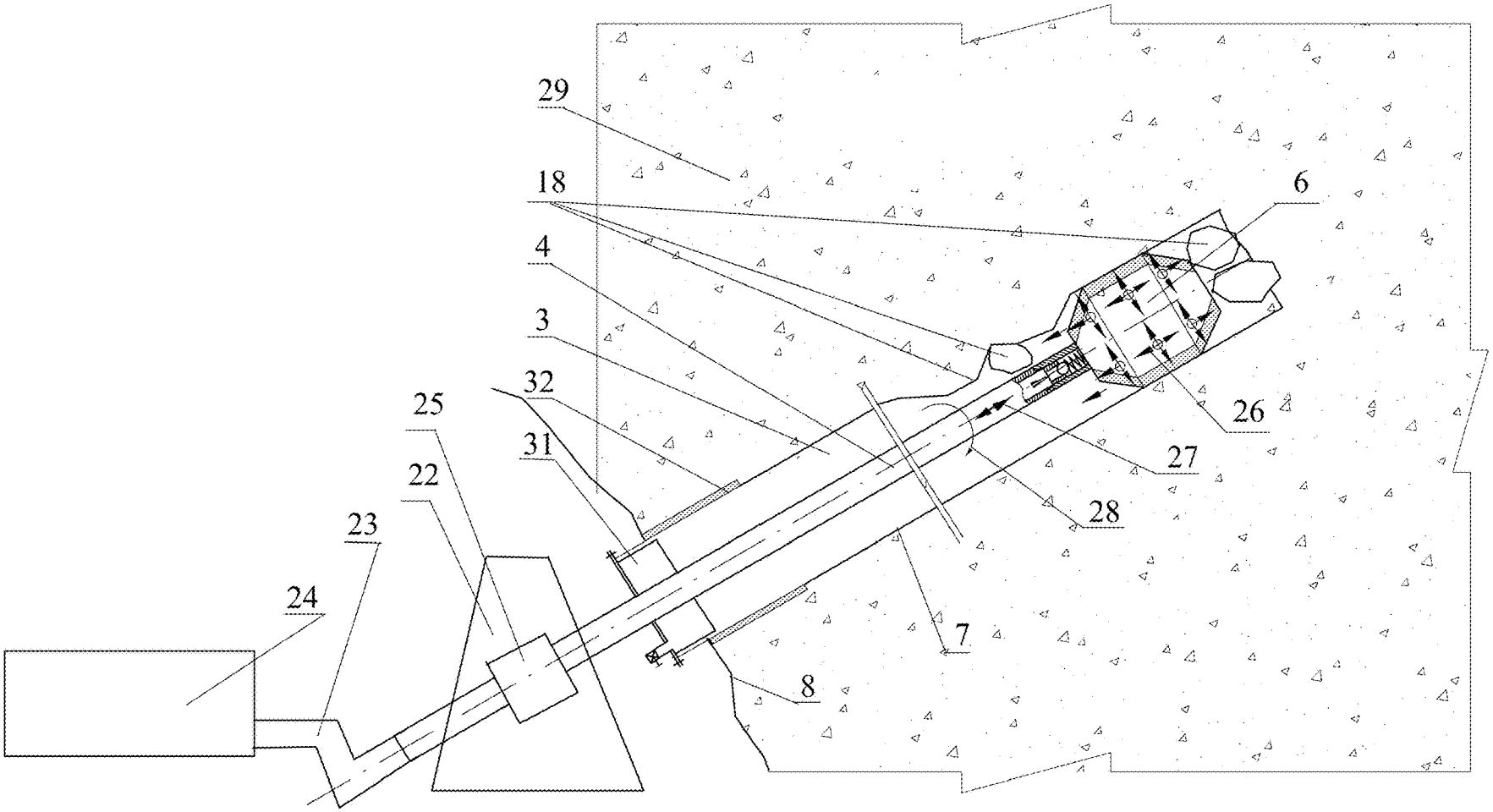
FIG. 11 is an installation structure diagram of a B-type jet grouting drill bit with bi-directional rib wings and an auxiliary device thereof.
Figure 12:
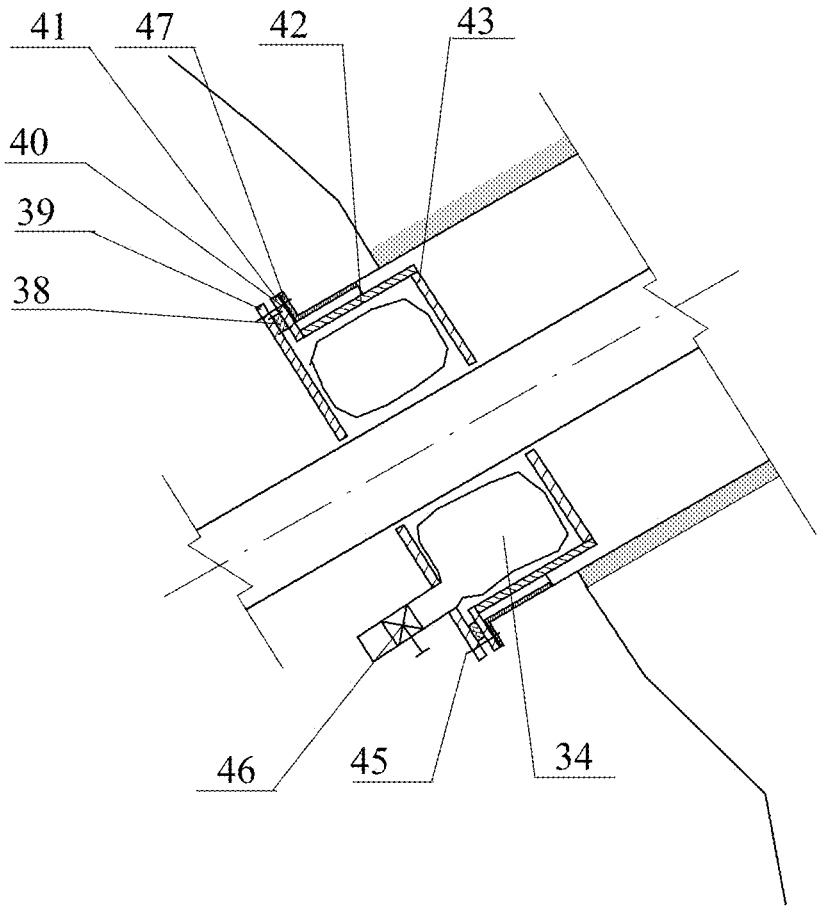
FIG. 12 is an assembly structure diagram of a B-type orifice sealing device.
Figure 13:
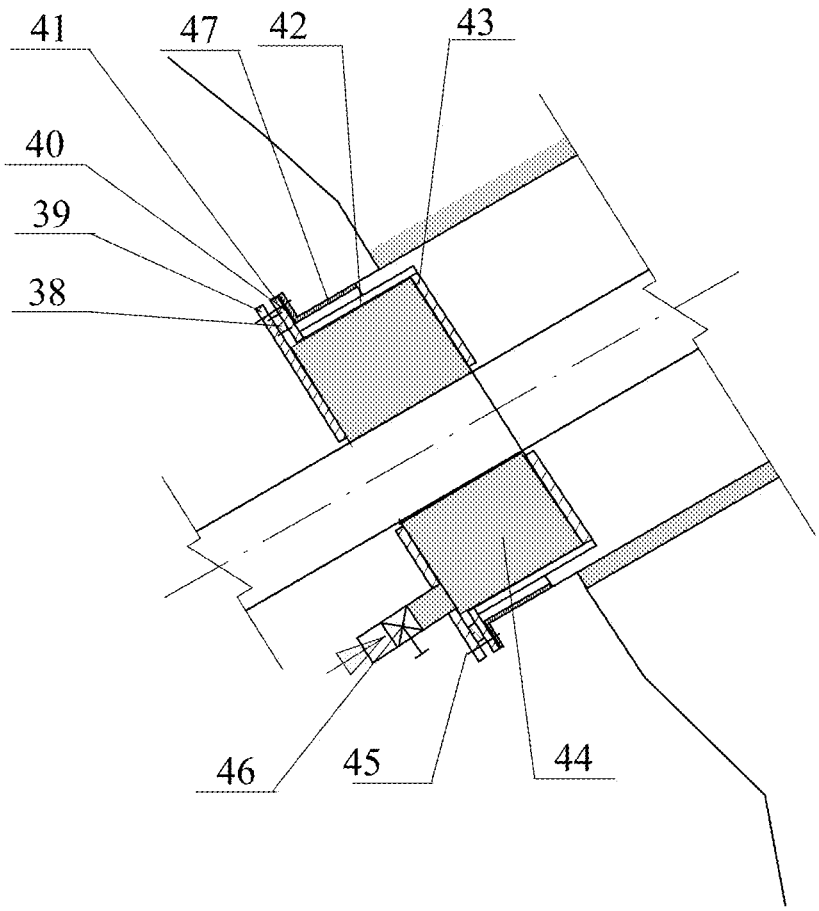
FIG. 13 is a working principle diagram of a B-type water seal.
Figure 14:
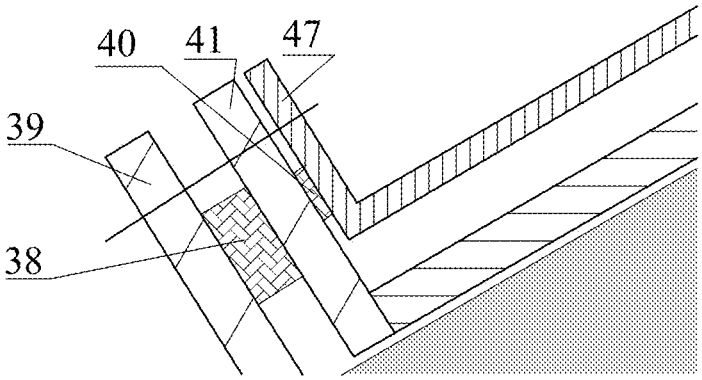
FIG. 14 is a partial enlarged structure diagram of a connection part of the B-type orifice sealing device.

The drill bit here may be specifically shaped to have a conical body at the front end, as shown in FIG. 1, or a horizontal end at the front end of the drill bit body, see FIG. 11, on condition that the drill bit includes the forward wing 19, the reverse wing 20 and the side wing 21.

The technical requirement of the manufacturing process for the jet grouting drill bit 6 with bi-directional rib wings in the anti-collapse grouting consolidation system is shown as follows: the drill bit body 15 is made of geological round steel, with the steel grade not lower than DZ45. The diameter of the inner through bore 16 is 28 mm, and the inner thread screw eye 13 is machined into the same inner buckle type as the screw thread of an outer flat drill rod 4 and is right-handed; there are three rib wings 14 with the thicknesses of 20 mm, and the side edge heights of the rib wings are determined by the difference between the diameter of a drill hole 3 and the diameter of the drill bit body 15, The rib wings 14 are uniformly distributed 120 degrees on the cross section of the drill bit body 15 and welded together with the drill bit body 15, and hard alloy fragments are welded on the rib wings 14. The hard alloy fragments may also be fixed on the rib wings by other ways, as long as the bonding parts can meet certain strength.

The outer edges of the three rib wings are required to be on the same cylindrical side surface, and it is better that the cylindrical axis is superposed with the axis of the drill bit body 15.

In the case that the cylindrical axis slightly deviates from the axis of the drill bit body or the outer edges of the rib wings are not on the same cylindrical surface, it still falls into the protection scope of the present invention as long as it can realize the function.

Figure 9:
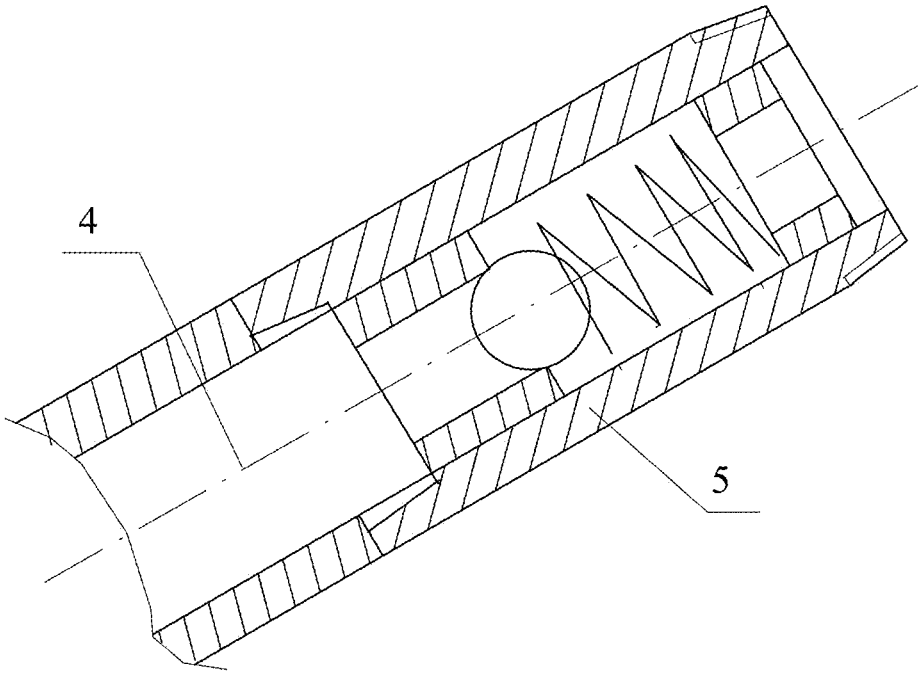
FIG. 9 is a structure diagram of a one-way valve.

The three rib wings are triangular on the upper and lower end faces of the drill bit body 15, and are combined into a triangular pyramid. The drill bit body 15 is machined with totally nine jet holes 17 having the diameters of 10 mm. The buckle type of the one-way valve 5 is same as that of the outer flat drill rod 4, the lower end is an outer buckle and is connected with the drill bit body 15 via the inner thread screw eye 13, and the upper end is of an inner buckle and is connected with the outer flat drill rod 4. The diameters of both the outer flat drill rod and the one-way valve are 50 mm. The structure and connection of the one-way valve 5 is shown in FIG. 9.

The specific dimensions of the components of the drill bit body herein are of a preferred embodiment, but the protection scope is not limited to the specific values mentioned here.

The number of the rib wings is not limited to three, may be four or other number. In the case of four rib wings, the rib wings 14 are uniformly distributed at 90 degrees on the cross section of the drill bit body.

The included angle between the forward wing 19 and the side wing 21, and also the included angle between the reverse wing 20 and the side wing 21 are preferably 135°, however, the actual included angles may be any degrees within the obtuse angle range.

An anti-collapse grouting consolidation system is formed by successively connecting the jet grouting drill bit 6 with bi-directional rib wings, the one-way valve 5, the outer flat drill rod 4, an A-type orifice sealing device 1, a chuck 25, an underground drill rig 22, a high-pressure pipeline 23 and a grouting pump 24 from bottom to top.

Figure 4:
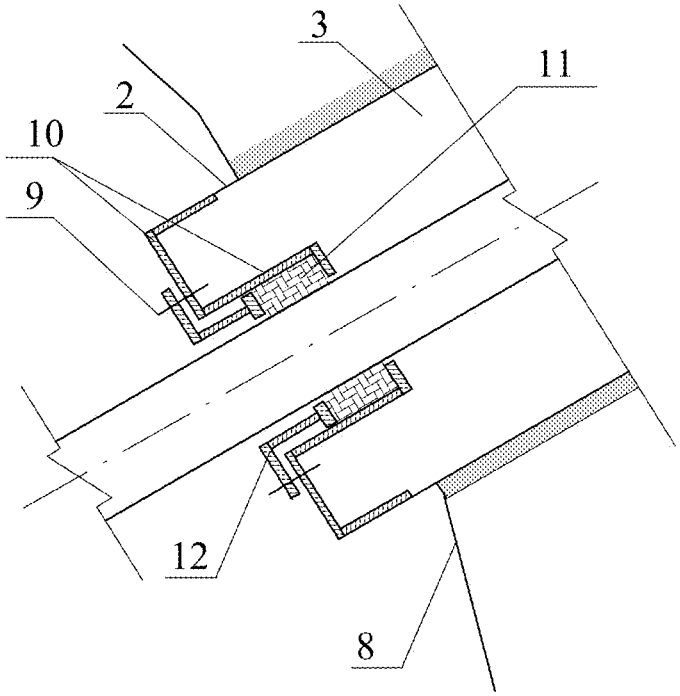
FIG. 4 is a structure diagram of an A-type orifice sealing device.
Figure 5:
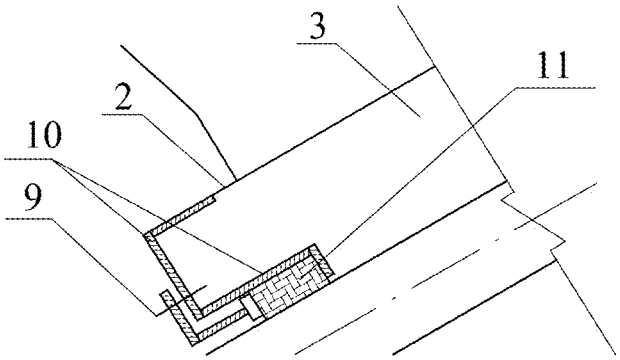
FIG. 5 is an assembly structure diagram of the A-type orifice sealing device.

The anti-collapse grouting consolidation system is installed on the premise that an A-type orifice pipe 2 is installed at the drill hole 3 and the cementing quality of the A-type orifice pipe 2 and the hole wall 7 is good. As shown in FIG. 4 and FIG. 5, the A-type orifice sealing device 1 is mainly composed of drag sleeves 10, fastening bolts 9, cotton packing threads 11 and press members 12. The drag sleeves 10 are connected with the A-type orifice pipe 2 by screw threads. After the outer flat drill rod 4 passes through the drag sleeves 10, the cotton packing threads 11 are filled into the drag sleeves 10, the press members 12 are installed, the press members 12 are connected with the drag sleeves 10 together by the fastening bolts 9, the fastening bolts 9 are screwed, and the cotton packing threads 11 are pressed by the press members 12. The cotton packing threads 11 expand to close the clearance with the outer flat drill rod 4.

The connection operation steps of all parts of the anti-collapse grouting consolidation system are as follows:

Step 1: connecting the jet grouting drill bit 6 with bi-directional rib wings, the one-way valve 5 and the outer flat drill rod 4 successively from bottom to top.

Step 2: putting the connected jet grouting drill bit 6 with bi-directional rib wings, one-way valve 5 and outer flat drill rod 4 into the drilled rod 3. Before they are put into the drill hole 3, the A-type orifice sealing device penetrates through the upper end of the outer flat drill rod 4, and then a hydraulic chuck of the underground drill rig 22 penetrates through the outer flat drill rod 4 and is tightened.

Step 3: installing the A-type orifice sealing device 1. The A-type orifice sealing device 1 and the A-type orifice pipe 2 are tightened, then the cotton packing threads 11 are filled into the drag sleeves 10 successively, the press members 12 are installed, and the fastening bolts 9 are connected (without compression, with gaps retained).

Step 4: slowly lowering the outer flat drill rod 4 held by the hydraulic chuck of the underground drill rig 22 into the drill hole 3.

Step 5: connecting the outer flat drill rod piece by piece for lengthening, and putting the jet grouting drill bit with bi-directional rib wings into the hole through the outer flat drill rod by using the hydraulic chuck of the underground drill rig 22 to reach the outer end of the hole segment that needs grouting reinforcement and drilling repair.

Step 6: connecting the outer flat drill rod 4, the high-pressure pipeline 23 and the grouting pump 24.

Figure 2:
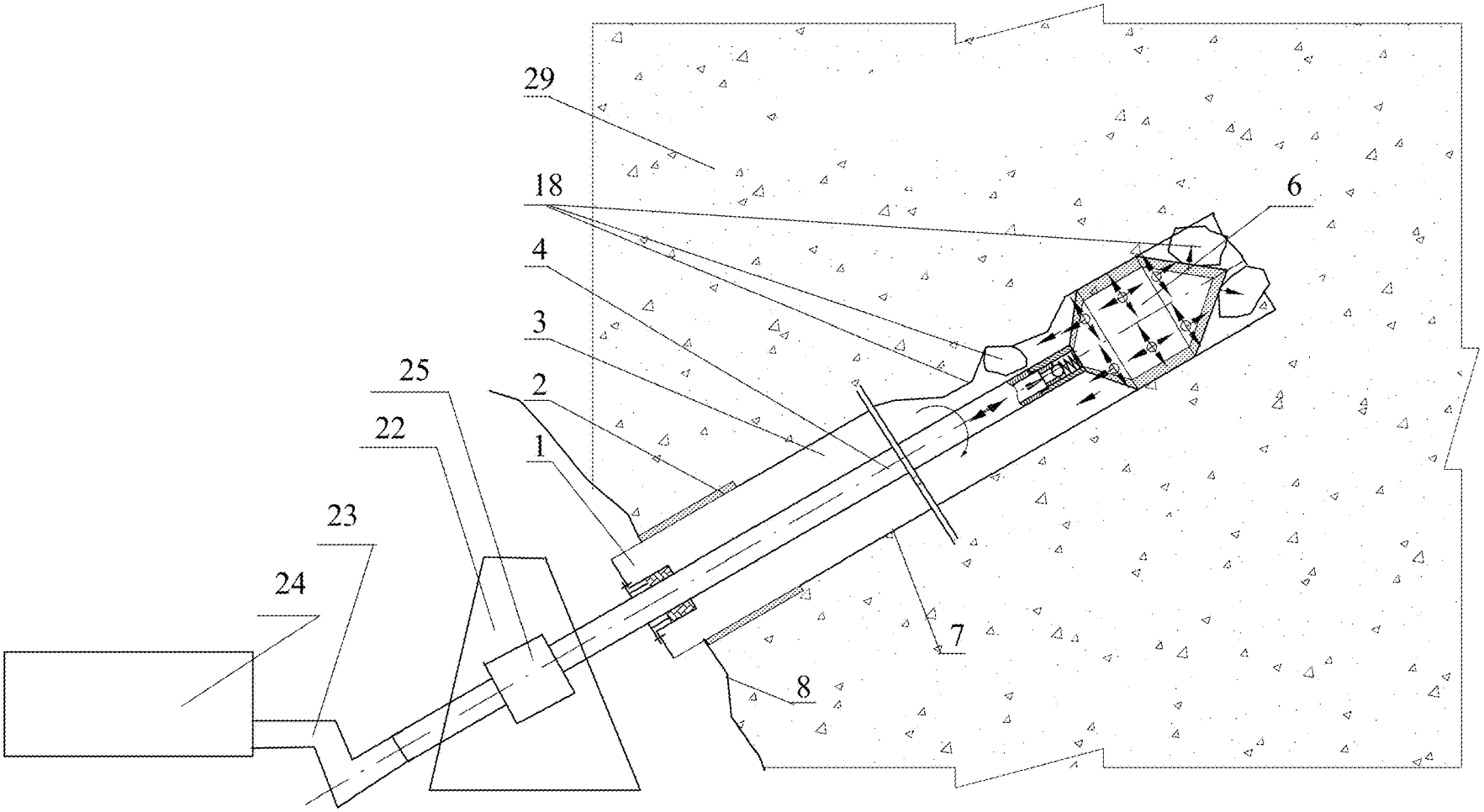
FIG. 2 is a working principle diagram of the A-type anti-collapse grouting consolidation system.

A using method of the anti-collapse grouting consolidation system shown in FIG. 2 includes the following steps:

Step 1: auxiliary devices for the anti-collapse jet grouting drill bit with bi-directional rib wings are installed.

Step 2: the grouting pump 24 is started to pump thin cement slurry into the drill hole 3 to flush the drill hole 3; and the cement slurry flows out from the gaps between the drag sleeves 10 and the outer flat drill rod 4.

Step 3: the underground drill rig 22 is started, and the outer flat drill rod 4 drives the jet grouting drill bit with bi-directional rib wings to rotate.

Step 4: the thin cement slurry is changed into quick-setting slurry, and the quick-setting slurry is injected into the drill hole 3 in flow direction 26 through the high-pressure hose 23, the outer flat drill rod 4 and the jet holes 17 of the jet grouting drill bit with bi-directional rib wings.

Step 5: after the quick-setting slurry flows out of the gaps between the drag sleeves 10 and the outer flat drill rod 4, the fastening bolts 9 are tightened, the press members 12 press the cotton packing threads 11, and the cotton packing threads 11 expand to close the clearance with the outer flat drill rod 4.

Step 6: slurry grouting is continued, until the grouting amount is 1.5-2.0 times the internal volume of the drill hole 3. Meanwhile, the underground drill rig 22 continues to drive the jet grouting drill bit 6 with bi-directional rib wings to rotate rightward 28, the outer flat drill rod 4 is fed into the drill hole 3, so that the jet grouting drill bit 6 with bi-directional rib wings slowly penetrates through the hole segment that needs grouting reinforcement and drilling repair; the rib wings 14 on the drill bit cut hole wall shrinkage-collapse chippings 18, or squeeze the chippings back into the hole wall 7 to repair the instable hole wall 7; and the hydraulic chuck of the drill rig clamps the outer flat drill rod 4 should not stop rotating, and the jet grouting drill bit 6 with bi-directional rib wings moves up and down 27 repeatedly in the hole segment.

Figure 3:
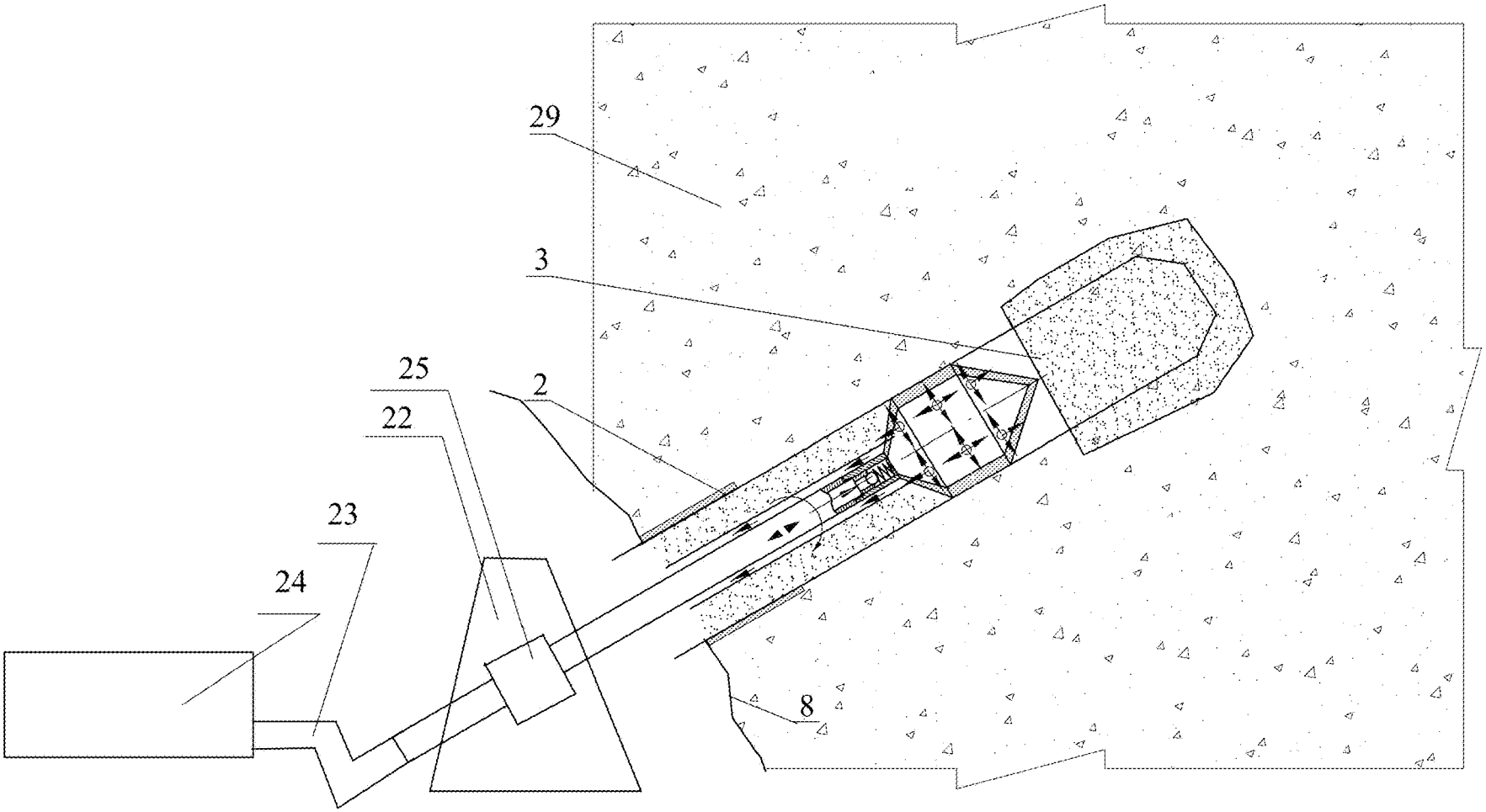
FIG. 3 is a working principle diagram of drilling towards the external direction of a drill hole after grouting to clear away consolidated slurry in the drill hole.

Step 7: as shown in FIG. 3, from the start of the grouting pump 24 to suck the slurry to 3 minutes before initial setting of the quick-setting slurry, the hydraulic chuck of the drill rig slowly rotates, and the outer flat drill rod 4 is withdrawn from the drill hole 3, so that the jet grouting drill bit 6 with bi-directional rib wings leaves the hole segment that needs grouting reinforcement and drilling repair. The withdrawal of the outer flat drill rod 4 is stopped after leaving, but the outer flat drill rod 4 should be rotated; the fastening bolts 9 are unscrewed to release the seal between the drag sleeves 10 and the outer flat drill rod 4, and clear water is pumped into the drill hole 3 by increasing the volume of the grouting pump 24, until the clear water returns between the A-type orifice sealing device 1 and the outer flat drill rod 4.

Step 8: rotation of the outer flat drill rod 4 is continued, while clear water is continuously pumped into the drill hole 3, until the outer flat drill rod 4 and the jet grouting drill bit 6 with bi-directional rib wings rotate freely in the drill hole 3.

Step 9: the grouting pump 24 is stopped, the hydraulic chuck of the underground drill rig 22 stops driving the outer flat drill rod 4 to rotate up and down, the outer flat drill rod 4 is detached at the orifice, and the A-type orifice sealing device 1 is detached.

Step 10: the outer flat drill rod 4 is reconnected, the grouting pump 24 is started, clear water is pumped into the drill hole 3 via the high-pressure hose 23, the outer flat drill rod 4 and the jet grouting drill bit 6 with bi-directional rib wings respectively, the drill rig is started to rotate slowly after the clear water returns from the orifice, and the outer flat drill rod 4 is pulled out, so that the rib wing at the upper end of the jet grouting drill bit 6 with bi-directional rib wings clears away the solidified quick-setting slurry outside the jet grouting drill bit 6 with bi-directional rib wings in the drill hole 3; and the outer flat drill rod 4 is detached piece by piece, until the jet grouting drill bit 6 with bi-directional rib wings is lifted out of the drill hole 3.

Step 11: the outer flat drill rod 4, the one-way valve 5 and the jet grouting drill bit with bi-directional rib wings are detached respectively. The operation steps are ended.

The technical requirements for safe operation are as follows:

In step 1, all devices must be inspected before connection to ensure normal operation; a thread compound must be used between the outer flat drill rod pieces, between the outer flat drill rod and the one-way valve, and between the one-way valve and the rib wing drill bit, and the components must be tightened and should not be subject to leakage at the threads.

In step 2, the density of the cement slurry is controlled at 1.2-1.4 g/cm$^3$, and the volume of the grouting pump is not more than 100 L/min.

In step 3, the rotating speed of the outer flat drill rod 4 driven by the underground drill rig 22 is not more than 150 r/min; and after the A-type orifice sealing device 1 is sealed with the outer flat drill rod 4, no leakage is required when the grouting pressure in the drill hole 3 is 1.5 MPa.

In step 4, the initial setting time of the quick-setting slurry is controlled at about 20-25 min, and must be tested before grouting; the limit value of the grouting pressure of the grouting pump 24 is controlled at 1.5 MPa; the pump volume of injecting the quick-setting slurry should not exceed 40 L/min; and the volume of the quick-setting slurry injected into the drill hole 3 is controlled between 1.5 and 2.0 times the internal volume of the drill hole 3. The grouting pressure is controlled at 1.0-1.2 MPa.

In step 5, after the press members 12 press tightly, the tightness between the cotton packing threads 11 and the outer flat drill rod 4 ensures no leakage when the grouting pressure is 1.5 MPa.

In step 6, the rotating speed of the outer flat drill rod 4 driven by the underground drill rig 22 is not more than 150 r/min. The up-down moving speed of the outer flat drill rod does not exceed 10 m/min.

In step 7, the pump volume of injecting the clear water is not less than 100 L/min.

The outer flat drill rod 4 can be stopped from rotating when the fastening bolts 9 are detached to release the seal between the drag sleeves 10 and the outer flat drill rod 4 in step 7, while in all other processes, the outer flat drill rod 4 should not be stopped or reversed, and pumping of the clear water should not be stopped.

The following safety attentions are emphasized in use of the anti-collapse grouting consolidation system:

(1) All parts of the outer flat drill rod 4, the one-way valve 5 and the jet grouting drill bit 6 with bi-directional rib wings must be connected firmly, and the phenomena of thread loosening and even thread-off at the connected positions should be avoided; (2) the one-way valve should not be reversed; (3) continuous supply and normal circulation of flushing fluid (or quick-setting slurry) in the hole must be ensured when the non-lift jet grouting drill bit 6 with bi-directional rib wings rotates and moves in the drill hole 3; (4) the entire operation, particularly the grouting process must ensure that the anti-collapse grouting consolidation device rotates and moves continuously and should not stop halfway; (5) the clearance between the orifice sealing device 1 and the outer flat drill rod 4 is not sealed to ensure that the outer flat drill rod 4 rotates and moves freely, and is sealed to ensure no leakage when the grouting pressure in the drill hole 3 reaches 1.5 MPa; (6) the right-hand rotation of the jet grouting drill bit 6 with bi-directional rib wings must be ensured throughout the operation to prevent left-hand rotation; (7) before the operation, the performance of the injected quick-setting slurry must be tested to master the initial setting time and the consolidation strength thereof accurately, otherwise, it shall not be used; and (8) the sealing quality between the orifice sealing device 1 and the outer flat drill rod also needs to be tested in advance to ensure no leakage during operation.

Embodiment 2

As shown in FIGS. 11-14, a B-type orifice sealing device 31 adopts the following structure, including: a pipe protection flange 47 in screwed connection with a B-type orifice pipe 32; an inner bushing 42 arranged in the B-type orifice pipe 32 and an inner bushing bottom holder 43, wherein an inner bushing flange 41 is arranged at the upper port of the inner bushing 42, the lower end of the inner bushing 42 is connected with the inner bushing bottom holder 43, and the inner bushing bottom holder 43 is disc-shaped and is provided in the center with a circular hole through which the outer flat drill rod 4 passes; a water bag 34 disposed in the inner bushing, after being filled with water and expanded, the water bag 34 forms a water seal 44 to seal the clearance between the outer flat drill rod 4 and the inner bushing 42, and a water inlet pipe and a high-pressure valve 46 connected with the water inlet pipe are arranged on the water seal 44;

A gland flange 39 is used for limiting expansion of the water weal 44 after water injection; wherein the sealing and the sealing degree of the orifice sealing device 1 are controlled by adjusting the water injection quantity of the water seal 44 to adapt to corresponding situations for different sealing requirements of the drill hole 3.

The inner bushing bottom holder 43, the inner bushing 42 and the inner bushing flange 41 are welded into a whole.

A second sealing gasket 40 is arranged between the pipe protection flange 47 and the inner bushing flange 41, and a first sealing gasket 38 is arranged between the inner bushing flange 41 and the gland flange 39.

The pipe protection flange 47, the inner bushing flange 41 and the gland flange 39 are connected by fastening bolts 45.

The diameter of the circular hole of the inner bushing bottom holder 43 is 4-6 mm greater than that of the outer flat drill rod 4.

The inner diameter of the inner bushing flange 41 is the same as that of the inner bushing 42, and the outer diameter of the inner bushing flange 41 is greater than that of the orifice pipe 32 and same as that of the pipe protection flange 47.

The water seal 44 is made of an elastic wear-resistant material and is in the shape of a ring, the outer diameter of the ring is the same as the inner diameter of the inner bushing 42, and the inner diameter of the ring is the same as the diameter of the circular hole of the inner bushing bottom holder 43.

The water inlet valve at the water seal 44 is a high-pressure valve 46 and has the same diameter as the water inlet, and a water pipe having the same diameter is connected outside the high-pressure valve 46.

Although the specific embodiments of the present invention are described above in combination with the accompanying drawings, the protection scope of the present invention is not limited thereto. It should be understood by those skilled in the art that various modifications or variations could be made by those skilled in the art based on the technical solution of the present invention without any creative effort, and these modifications or variations shall fall into the protection scope of the present invention.

The invention claimed is:

1. An anti-collapse grouting consolidation system, comprising:

a grouting pump;

a high-pressure pipeline, connected with the grouting pump;

an outer flat drill rod, connected with the high-pressure pipeline;

a drill rig, wherein the outer flat drill rod penetrates through an inner through bore of a chuck of the drill rig, and the chuck of the drill rig clamps the outer flat drill rod;

an orifice sealing device, configured to be sheathed on the outer flat drill rod at an orifice of a drill hole to ensure that the outer flat drill rod is sealed with the orifice of the drill hole, the orifice sealing device comprising:

a pipe protection flange, connected with an orifice pipe;

an inner bushing arranged in the orifice pipe and an inner bushing bottom holder, wherein an inner bushing flange is arranged at an upper port of the inner bushing, a lower end of the inner bushing is connected with the inner bushing bottom holder, and the inner bushing bottom holder is disc-shaped and is provided in a center of the inner bushing bottom holder with a circular hole through which the outer flat drill rod passes;

a water seal, disposed in the inner bushing, and configured to seal a clearance between the outer flat drill rod and the inner bushing, wherein a water inlet pipe and a high-pressure valve connected with the water inlet pipe are arranged on the water seal; and a gland flange configured to limit expansion of the water seal after water injection, wherein a degree of sealing of the orifice sealing device is controlled by adjusting a quantity of water, injected into the water seal, to adapt to corresponding situations for different sealing requirements of the drill hole; and a jet grouting drill bit with bi-directional rib wings, connected with a one-way valve which is connected with the outer flat drill rod;

wherein:

the grouting pump is configured to jet quick-setting slurry into the drill hole through a high-pressure hose, the outer flat drill rod and the jet grouting drill bit with bi-directional rib wings successively to realize static osmotic jet grouting, and the drill rig is configured to drive, through the outer flat drill rod, the jet grouting drill bit with bi-directional rib wings to rotate to cut chippings or squeeze the chippings back into a hole wall of the drill hole by means of the jet slurry and rotation of the rib wings so as to repair the hole wall.

2. The anti-collapse grouting consolidation system according to claim 1, wherein the pipe protection flange is in screwed connection with the orifice pipe.

3. The anti-collapse grouting consolidation system according to claim 1, wherein the inner bushing bottom holder, the inner bushing and the inner bushing flange are welded into a whole.

4. The anti-collapse grouting consolidation system according to claim 1, wherein a second sealing gasket is arranged between the pipe protection flange and the inner bushing flange, and a first sealing gasket is arranged between the inner bushing flange and the gland flange; and the pipe protection flange, the inner bushing flange and the gland flange are connected by fastening bolts.

5. The anti-collapse grouting consolidation system according to claim 1, wherein a diameter of the circular hole of the gland flange is 4-6 mm greater than a diameter of the outer flat drill rod; an inner diameter of the inner bushing flange is the same as an inner diameter of the inner bushing; and an outer diameter of the inner bushing flange is greater than an outer diameter of the orifice pipe.

6. The anti-collapse grouting consolidation system according to claim 1, wherein the water seal is made of an elastic wear-resistant material and is in the shape of a ring, an outer diameter of the ring is the same as the inner diameter of the inner bushing, and an inner diameter of the ring is the same as the diameter of the circular hole of the inner bushing bottom holder.

7. The anti-collapse grouting consolidation system according to claim 1, wherein a water inlet valve at the water seal is a high-pressure one and has the same diameter as the water inlet, and a water pipe with the same diameter is connected outside the high-pressure valve.

8. The anti-collapse grouting consolidation system according to claim 1, wherein:

the orifice sealing device is composed of drag sleeves, fastening bolts, cotton packing threads and press members, and the drag sleeves are connected with the orifice pipe by screw threads, and the orifice sealing device is configured so that, when sealing the outer flat drill rod with the orifice of the drill hole:

the outer flat drill rod passes through the drag sleeves, the cotton packing threads are filled into the drag sleeves, the press members are connected with the drag sleeves together by the fastening bolts, and the cotton packing threads are pressed by the press members and expanded to close the clearance with the outer flat drill rod.

9. A method of using an anti-collapse grouting consolidation system, the method comprising the following steps:

step 1: feeding a jet grouting drill bit with bi-directional rib wings connected with an outer flat drill rod into a drill hole to a certain depth, sheathing a sealing device outside the outer flat drill rod, fixing the sealing device at the orifice of the drill hole, and connecting the outer flat drill rod to a high-pressure pipeline and a grouting pump successively after the outer flat drill rod passes through a chuck of a drill rig;

step 2: injecting thin cement slurry into the drill hole to flush the drill hole; after the drill hole is full of the thin cement slurry, starting the drill rig to ensure the jet grouting drill bit with bi-directional rib wings rotates, and injecting quick-setting slurry, until the quick-setting slurry overflows between the orifice sealing device and the drill rod;

step 3: sealing the orifice of the drill hole by the orifice sealing device, then conveying the rotating drill bit to a repair segment by the outer flat drill rod, stopping injecting the quick-setting slurry after a grouting pressure reaches a set value, and continuing keeping the anti-collapse jet grouting drill bit with bi-directional rib wings repeatedly moving up and down and rotating at the repair segment to repair the repair segment, until the repair process meets a set requirement;

step 4: after the repair reaches a setting time, pulling out the outer flat drill rod from the drill hole, so that the jet grouting drill bit with bi-directional rib wings leaves the hole segment that needs grouting reinforcement and drilling repair, and releasing the seal of the sealing device at the orifice; injecting clear water into the drill hole until the clear water overflows between the orifice sealing device and the outer flat drill rod, stopping the drill rig after the drill bit rotates freely in the drill hole, and detaching the outer flat drill rod at the orifice; and step 5: detaching the orifice sealing device, reconnecting the outer flat drill rod, pumping clear water into the drill hole via the grouting pump, starting the drill rig to rotate slowly and pulling up the outer flat drill rod after the clear water returns from the orifice, therefore, the rib wing at the upper end of the jet grouting drill bit with bi-directional rib wings cuts towards an external direction of the drill hole to clear away the solidified quick-setting slurry in the drill hole, and detaching the outer flat drill rod piece by piece, until the jet grouting drill bit with bi-directional rib wings is lifted out of the drill hole, thus ending the operation steps, wherein in step 2, a pump volume of the grouting pump is not more than 100 L/min, and a rotating speed of the outer flat drill rod driven by the drill rig is not more than 150 r/min.

10. The method according to claim 9, wherein a volume of the quick-setting slurry injected into the drill hole is controlled between 1.5 and 2.0 times an internal volume of the drill hole.

11. The method according to claim 9, wherein in step 2, an initial setting time of the quick-setting slurry is controlled at 20-25 min a limit value of the grouting pressure of the grouting pump is controlled at 1.5 MPa; and a pump volume of injecting the quick-setting slurry does not exceed 40 L/min.

12. The method according to claim 9, wherein in step 3, the set value of the grouting pressure is 1.0-1.2 MPa; the rotating speed of the outer flat drill rod driven by the drill rig is not more than 150 r/min; and an up-down moving speed of the outer flat drill rod is not more than 10 m/min.

13. The method according to claim 9, wherein in step 4, a set time reached by the repair is 3 minutes before the quick-setting slurry reaches quick-setting.

14. The method according to claim 9, wherein in step 4, a pump volume of injecting the clear water is not less than 100 L/min; and after the clear water flows out from the orifice and the drill bit rotates freely in the drill hole, the drill rig stops rotating.

15. A method of using an anti-collapse grouting consolidation system, the method comprising the following steps:

step 1: feeding a jet grouting drill bit with bi-directional rib wings connected with an outer flat drill rod into a drill hole to a certain depth, sheathing a sealing device outside the outer flat drill rod, fixing the sealing device at an orifice of the drill hole, and connecting the outer flat drill rod to a high-pressure pipeline and a grouting pump successively after the outer flat drill rod passes through a chuck of a drill rig;

step 2: injecting thin cement slurry into the drill hole to flush the drill hole;

after the drill hole is full of the thin cement slurry, starting the drill rig to ensure the jet grouting drill bit with bi-directional rib wings rotates, and injecting quick-setting slurry, until the quick-setting slurry overflows between the orifice sealing device and the drill rod;

step 3: sealing the orifice of the drill hole by the orifice sealing device, then conveying the rotating drill bit to a repair segment by the outer flat drill rod, stopping injecting the quick-setting slurry after the grouting pressure reaches a set value, and continuing keeping the anti-collapse jet grouting drill bit with bi-directional rib wings repeatedly moving up and down and rotating at the repair segment to repair the repair segment, until the repair process meets a set requirement;

step 4: after the repair reaches a setting time, pulling out the outer flat drill rod from the drill hole, so that the jet grouting drill bit with bi-directional rib wings leaves a hole segment that needs grouting reinforcement and drilling repair, and releasing a seal of the sealing device at the orifice; injecting clear water into the drill hole until the clear water overflows between the orifice sealing device and the outer flat drill rod, stopping the drill rig after the drill bit rotates freely in the drill hole, and detaching the outer flat drill rod at the orifice; and step 5: detaching the orifice sealing device, reconnecting the outer flat drill rod, pumping clear water into the drill hole via the grouting pump, starting the drill rig to rotate slowly and pulling up the outer flat drill rod after the clear water returns from the orifice, therefore, the rib wing at an upper end of the jet grouting drill bit with bi-directional rib wings cuts towards an external direction of the drill hole to clear away the solidified quick-setting slurry in the drill hole, and detaching the outer flat drill rod piece by piece, until the jet grouting drill bit with bi-directional rib wings is lifted out of the drill hole, thus ending the operation steps, wherein in step 3, the set value of the grouting pressure is 1.0-1.2 MPa; a rotating speed of the outer flat drill rod driven by the drill rig is not more than 150 r/min; and an up-down moving speed of the outer flat drill rod is not more than 10 m/min.

* * * * *